US010561571B2

(12) United States Patent
Jackson et al.

(10) Patent No.: US 10,561,571 B2
(45) Date of Patent: Feb. 18, 2020

(54) PRESSURE CUFF OR GARMENT

(71) Applicant: HUNTLEIGH TECHNOLOGY LIMITED, Dunstable (GB)

(72) Inventors: Philip Jackson, Chepstow (GB); Champaben Patel, Cardiff (GB)

(73) Assignee: Huntleigh Technolagy Limited (GB)

( * ) Notice: Subject to any disclaimer, the term of this patent is extended or adjusted under 35 U.S.C. 154(b) by 498 days.

(21) Appl. No.: 14/700,668

(22) Filed: Apr. 30, 2015

(65) Prior Publication Data

US 2015/0245976 A1 Sep. 3, 2015

Related U.S. Application Data

(63) Continuation-in-part of application No. PCT/GB2013/052786, filed on Oct. 25, 2013.

(51) Int. Cl.
*A61H 9/00* (2006.01)

(52) U.S. Cl.
CPC ... *A61H 9/0092* (2013.01); *A61H 2201/0103* (2013.01); *A61H 2201/165* (2013.01); *A61H 2201/1697* (2013.01); *A61H 2205/106* (2013.01); *A61H 2209/00* (2013.01)

(58) Field of Classification Search
CPC ..... A61H 7/007; A61H 9/005; A61H 9/0078; A61H 9/0092; A61H 2201/0157; A61H 2201/164; A61H 2201/1642; A61H 2201/1645; A61H 2201/1647; A61H 2205/10; A61H 2205/106; A61H 2209/00; A61B 17/135
USPC ..... 128/DIG. 20
See application file for complete search history.

(56) References Cited

U.S. PATENT DOCUMENTS 2,880,721 A * 4/1959 Corcoran ..... A61H 9/0078 128/DIG. 20
3,987,506 A * 10/1976 Markwitz ..... A61H 37/00 601/149
4,029,087 A * 6/1977 Dye ..... A61B 17/135 601/152
4,597,384 A * 7/1986 Whitney ..... A61F 13/085 128/DIG. 20

(Continued)

FOREIGN PATENT DOCUMENTS

CN 101048117 A 10/2007
CN 102440895 A 5/2012

(Continued)

OTHER PUBLICATIONS

International Search Report issued for corresponding International Patent Application No. PCT/GB2013/052786, dated Jan. 28, 2014, 2 pages.

*Primary Examiner* — Tu A Vo
(74) *Attorney, Agent, or Firm* — The Webb Law Firm

(57) ABSTRACT

A pressure cuff or garment for prophylactic treatment of deep vein thrombosis includes a series of three chambers arranged in series and coupled fluidically to one another by bleed tubes or chokes. The chambers are otherwise sealed to the environment, save for the first chamber which also provides an inlet/outlet for coupling to a fluid pump. The chambers are also of curved shape so as to overlap one another. The cuff or garment provides more effective pulsating pressure treatment than prior art structures.

17 Claims, 8 Drawing Sheets

(56) References Cited

U.S. PATENT DOCUMENTS 5,211,162 A * 5/1993 Gillen, Jr. ..... A61H 9/0078 601/149
5,288,286 A * 2/1994 Davis ..... A61F 5/0111 602/13
6,007,559 A * 12/1999 Arkans ..... A61B 17/135 601/150
6,203,510 B1 * 3/2001 Takeuchi ..... A61H 9/0078 601/152
8,016,779 B2 * 9/2011 Brown ..... A61H 9/0078 601/152
2001/0034545 A1 * 10/2001 Elkins ..... A61F 7/02 607/108
2002/0019657 A1 * 2/2002 Elkins ..... A61F 7/02 607/111
2005/0070828 A1 * 3/2005 Hampson ..... A61F 5/012 601/152
2005/0256556 A1 * 11/2005 Schirrmacher ..... A61F 7/02 607/104
2007/0088239 A1 * 4/2007 Roth ..... A61H 9/0078 601/152
2007/0161933 A1 * 7/2007 Ravikumar ..... A61G 7/0755 602/13
2007/0249977 A1 * 10/2007 Bonnefin ..... A61H 9/0078 602/13
2008/0249440 A1 10/2008 Avitable et al.
2010/0210982 A1 * 8/2010 Balachandran ..... A61F 7/0085 601/152
2010/0249679 A1 9/2010 Perry et al.
2011/0098792 A1 * 4/2011 Lowe ..... A61F 7/02 607/104
2012/0172774 A1 * 7/2012 Lowe ..... A61F 7/02 602/13
2013/0085431 A1 * 4/2013 Malhi ..... A61H 9/0078 601/150

FOREIGN PATENT DOCUMENTS

CN 102525415 A 7/2012
EP 2 436 308 A1 4/2012
EP 2 444 041 A1 4/2012
JP 7171185 A 7/1995
JP 9313557 A 12/1997
JP 2008284346 A 11/2008
JP 2016512438 A 4/2016
WO 9817221 A1 10/1996
WO 03/007855 A1 1/2003
WO 2014068288 A1 5/2014

* cited by examiner

PRIOR ART

PRIOR ART

PRESSURE CUFF OR GARMENT

CROSS REFERENCE TO RELATED APPLICATIONS

This application is a continuation-in-part of International Patent Application No. PCT/GB2013/052786, filed on Oct. 25, 2013, pursuant to 35 USC § 371, which in turn claims benefit of priority to Patent Application No. GB1219496.5, filed on Oct. 30, 2012, the entire disclosures of which are expressly incorporated by reference herein.

FIELD OF THE INVENTION

The present invention relates to a pressure cuff or garment, particularly suitable for the deep vein thrombosis prophylaxis.

BACKGROUND OF THE INVENTION

One of the key accepted principles of deep vein thrombosis (hereinafter DVT) prophylaxis is the application of intermittent compression to the limbs of a patient, particularly in the legs, where DVT is most commonly experienced. The intention of such intermittent compression is to prevent blood stasis, which can result in thrombus formation. Specifically, the treatment temporarily occludes the patient's vessels by compressing the veins, and then opens these by release of the compressive pressure, leading to a burst of blood flow through the veins and thus avoidance of long term stasis. Thus, in general, are two distinct phases to an applied DVT therapy profile. There is a first inflation period where the pressure is applied to the patient's anatomy, followed by a second (wait) period of time during which this pressure is reduced or removed to allow for the refilling of vessels. This cycle is then repeated in order to maintain the augmentation of the patient's blood velocity and therefore prevent venous stasis.

In order to obtain the maximum performance of the garment it is important to get the maximum clinical effect during the first period where pressure is applied, whilst also maximising the clinical effect during the second period. These two periods require different functions and characteristics in order to optimise the overall therapy applied and the resulting clinical effects.

The applicant's earlier US-2005/070,828 discloses a garment designed to provide a sequential DVT prevention therapy via a single tube inlet. The garment includes a plurality of inflatable and deflatable chambers, in which deflation occurs by means of bleed or exhaust valves in order to maintain the correct pressure in the mid and proximal chambers. However, the bleed valves can in some circumstances give the impression that the garment is leaking, leading to user anxiety and risk of ineffective use. The device of this earlier application also requires the management of the following variables: the individual chamber volume; the dimensions of the interconnecting bleed tubes; and the dimensions of the mushroom bleed grommets.

SUMMARY OF THE INVENTION

The present invention seeks to provide an improved garment or cuff for the treatment of a patient, particularly for the prophylaxis of deep vein thrombosis.

According to an aspect of the present invention, there is provided an inflatable garment for application to a patient, the garment including first and second inflatable chambers, a first of said chambers including an inlet and outlet, the second chamber including a choke, said choke connecting the first chamber to the second chamber, the second chamber being sealed save through said choke.

Preferably, there is provided at least one intermediate chamber disposed between said first and second chambers, there being provided a choke from said first chamber to the intermediate chamber or a first intermediate chamber and a choke from said intermediate chamber or a last intermediate chamber to said second chamber, the or each of said intermediate chambers being sealed saved through said chokes.

The chambers are preferably permanently sealed apart from through said chokes and, in the case of the first chamber, sealed save through said inlet, said outlet and any chokes connected thereto. Thus, the second and any intermediate chambers are filled and exhausted through the chokes, without there being a separate exhaust.

The structure is such that inflation fluid can be fed into the first chamber, which fluid not only inflates the first chamber but also the second chamber and any intermediate chamber coupled to the first chamber. The second and any intermediate chamber is not inflated by any other source apart from through its choke(s). Furthermore, deflation of the chambers occurs only through the chokes, in the case of the second and any intermediate chambers, and through the inlet and outlet of the first chamber. Thus, there is no external venting of the chambers as occurs, for instance, in the applicant's earlier device disclosed in US-2005/070,828.

In the preferred embodiment, there are provided at least three chambers arranged in series.

Advantageously, the chokes are sized to provide a given relative rate of inflation and deflation to the chambers, and as a result a given pressure profile to each chamber. In particular, the chokes preferably have different sizes, thereby to provide different rates of inflation and/or deflation of their associated chamber and different pressures in the chambers.

The chokes are preferably in the form of connecting tubes, the connecting tubes having different sizes. The tubes are preferably open tubes, that is without any valves therein.

In an embodiment, the bleed tubes have the following dimensions. The first bleed tube between the first chamber and the second or a mid chamber is about 80 mm long, with an internal bore diameter of about 0.8 mm. A second bleed tube between the mid chamber and the second chamber is about 20 mm long, with an internal bore diameter of about 0.5 mm.

The chambers are preferably interspersed with each other to provide a blended progression of the chamber edges. The periphery is advantageously not a uniform shape, being is instead a sequence of curves. Hence, there are circumferential areas around the leg that have mid and distal chambers applied in different areas. In terms of the distance measured from the distal end of the garment, each chamber has a variable value dependent on the circumferential position under consideration.

In the preferred embodiment, the most distally located chamber is the largest in terms of volume, the next (middle) chamber is smaller than the distal chamber, and the most proximal chamber is smaller again. The chamber dimensions are approximately as follows: or the mid chamber is approximately 70% of the size of the first or distal chamber, the second or proximal chamber is approximately 55% of the size of the first or distal chamber. The inflated volumes of the individual chambers is approximately in the same relative proportions.

According to another aspect of the present invention, there is provided an inflatable garment for application to a patient, the garment having a length, a width and a contour, the garment including a plurality of inflatable chambers arranged adjacent one another along the length of the garment, the inflatable chambers being curved along the width of the garment.

Preferably, adjacent chambers overlap one another in the direction of the length of the garment.

It is to be understood that embodiments of the invention may include any or all of the features of the above-described aspects or combinations thereof.

The garment may be a cuff, sleeve or other garment, shaped to fit around a part of the anatomy of a patient. Typically, the garment will be shaped to fit around a part of a leg of a patient.

It will be appreciated that the garment will typically be made of flexible material and therefore conformable to the shape of the patient.

BRIEF DESCRIPTION OF THE DRAWINGS

Embodiments of the present invention are described below, by way of example only, with reference to the accompanying drawings, in which:

FIG. 11 shows a bladder of the garment of FIG. 4; and

FIG. 12 shows a bladder according to one embodiment disclosed herein.

DETAILED DESCRIPTION

In the embodiments disclosed below the described garment is designed for fitting around a patient's calf. It is to be understood, though, that the garment may have many different shapes, designed to fit around different parts of a patient's anatomy. Typically, the garment will be designed to fit around a part of or the whole of a patient's leg, but it may also be designed to fit around a patient's arm or other body part. For this purpose, although the embodiment of garment described below comprises three inflatable chambers, it may have a different number of chambers, dependent primarily on the overall dimensions of the garment, the sizes of the chambers and the pressure profile which is to be generated across the garment. In some cases, therefore, the garment may have just two chambers, whereas in other embodiments the garment may have more than three chambers, for instance four, five or more.

Figure 1:
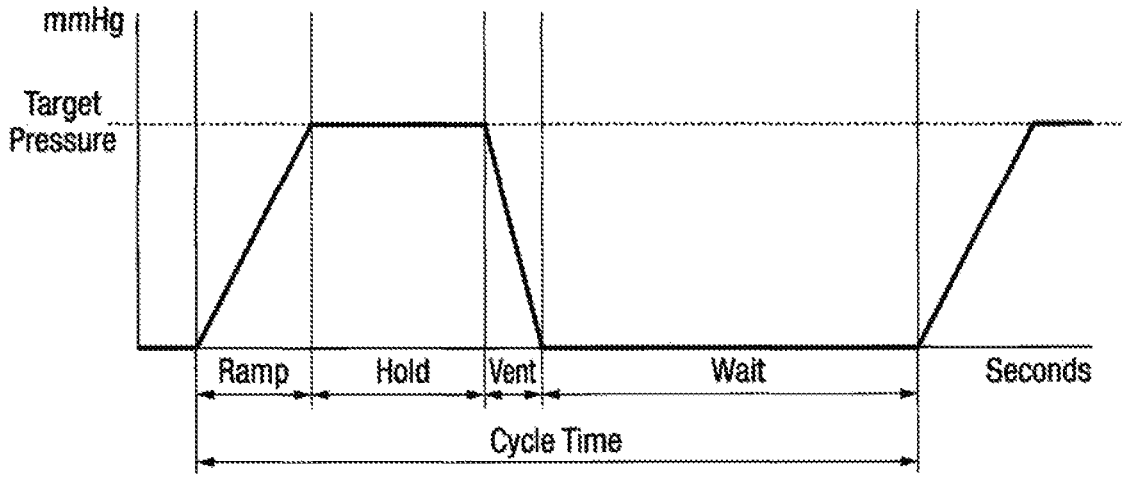
FIG. 1 is a graph of a typical pressure duty cycle for the prophylactic treatment of deep vein thrombosis.

As part of an integrated DVT prophylaxis system, the garment provides the physical therapy delivery interface between the system and the patient. The principle of operation of the garment described below is to impart sufficient contact pressure on the calf or calf and thigh region of a patient's leg, to occlude temporarily the deep veins embedded within the calf, thus stopping venous return to the heart for the duration of the applied pressure. After a pre-determined period, e.g., of around 12 seconds from the start of inflation, the pressure in the garment is released so as to allow venous blood to re-perfuse. After a wait period, e.g., of around 48 seconds, the inflation cycle is repeated so as to occlude the vein once more. This cycle is repeated as long as the garment is fitted to the patient's calf and a pump in fluid communication with chambers of the garment is running. An image of this example of therapy cycle is shown in FIG. 1. The inflation part of the overall cycle consists of the distinct parts, namely: ramp, hold and vent. This is the duty cycle for the distal chamber of the garment, from which the pressures produced in the mid and proximal chambers are derived, as described below.

Figure 2:
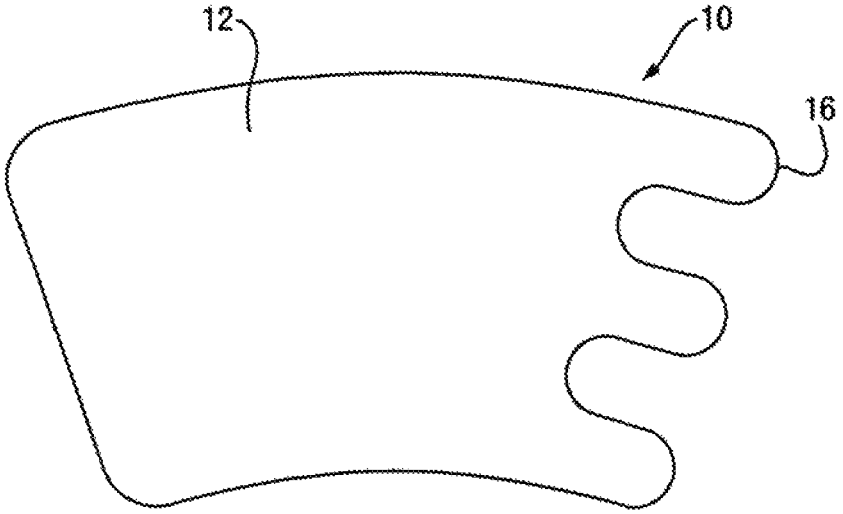
FIGS. 2 and 3 are, respectively, outside and inside views (with respect to the orientation of the garment when worn by a patient) of an example of garment designed for attachment to the calf of a patient.
Figure 3:
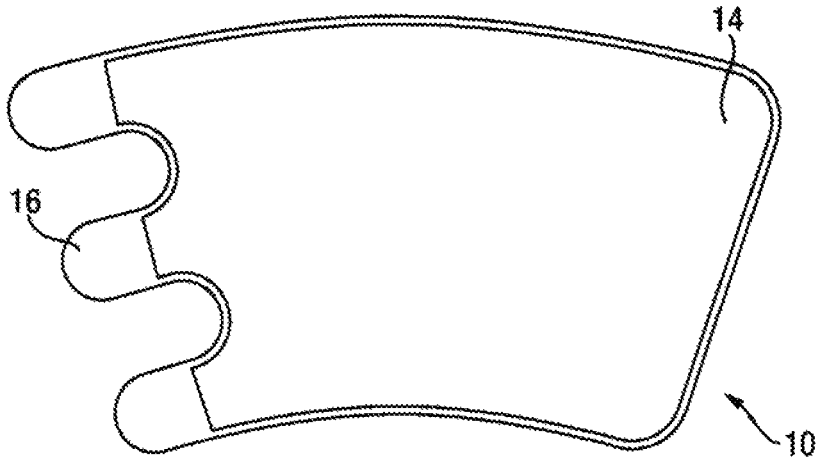

Referring now to FIGS. 2 and 3, these show, respectively, views of an embodiment of garment 10 from the outside 12 and the inside 14. By outside it is to meant the side facing away from the patient's anatomy when attached to a patient and by inside it is meant the opposite side that is facing toward, abutting, or touching the patient's anatomy. The garment 10 is illustrated in FIGS. 2 and 3 in the form of a calf cuff, and therefore may be referred to herein as the "cuff 10" or "calf cuff 10" although it is reiterated that the garment 10 may be used on or modified for use on any other anatomical structure and that reference to the calf is not intended to be limiting. The portion of the garment 10 forming the chambers 24, 26, and 28, which in one embodiment may be a bladder 22, is made from two layers or plies of a compliant, soft and impervious polymer material such as polyvinyl chloride (PVC), or polyurethane/olefin film, although other materials suitable for receiving a fluid flow to pressurize a patient's anatomy may be used. The plies may be sealed to one another to form, in this embodiment, three chambers interconnected by chokes, as described in detail below. The bladder 22 may be housed within a cover 20, e.g., between two layers of the cover 20 and/or within a pocket formed by the cover 20. Since the cover 20 may be in intimate contact with the skin of a patient during use of the garment 10, the cover 20 may be or include a suitably soft, flexible, breathable, and/or wicking material, e.g., a woven fabric, that is comfortable when worn, promotes airflow to the patient's skin, pulls moisture away from the patient's skin, etc.

The garment 10 also includes a plurality of fixation tabs 16, in this embodiment three, which are used to fix the cuff 10 in position around a patient's calf. For this purpose, the tabs 16 may be provided adhesive, hook and/or eye fastenings or other suitable fastenings. It will be appreciated that the fabric of a cover 20 for the garment 10 may be the hook and/or eye fastenings that cooperates as a suitable receptor material for fastening the garment 10 closed, and/or separate hook and eye materials may be affixed to the garment 10.

As will be apparent from FIGS. 2 and 3, the cuff 10 may be laid out flat and in use would be wrapped around a person's calf or lower leg, in the form of a sleeve.

It will be appreciated that the shape of the garment would be designed for the particular part of the anatomy of a patient and may therefore differ from the example shown in the drawings.

Figure 4:
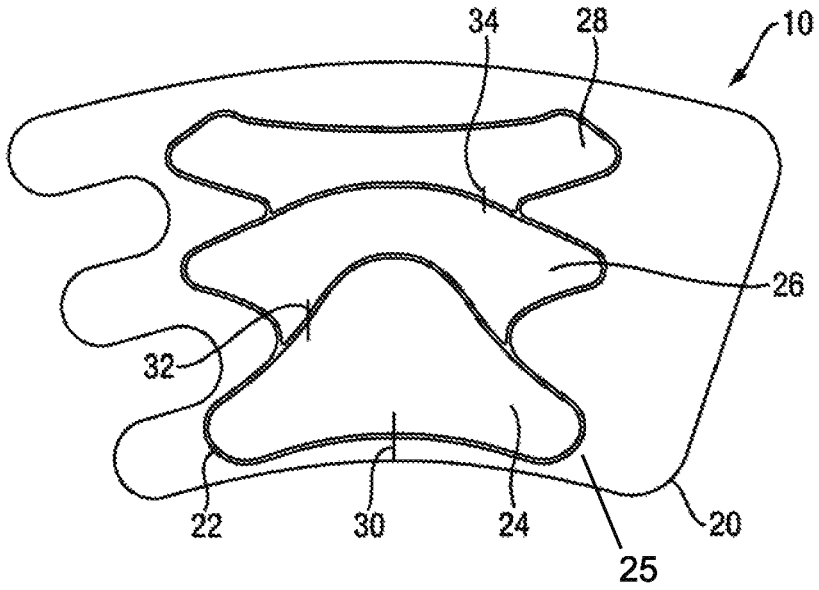
FIG. 4 is a schematic diagram of an embodiment of garment calf designed for attachment to the calf of a patient.

FIG. 4 shows in more detail the construction of the cuff 10 and in particular of the inflatable chambers of the bladder 22 of the cuff 10. The bladder 22 may include an outer edge 25 at which the plies of the bladder 22 are bonded to one another, although this is not necessary. The plies of the bladder 22 may be bonded along lines which define, in this illustrated embodiment, a three chamber bladder 22 formed of a first or distal chamber 24, at least one intermediate or mid chamber 26, and a proximal chamber 28. The terms distal and proximal are used for the sake of discussion only and are not intended to be limiting. With specific reference to the garment 10 when used on a patient's calf, the distal chamber 24 may accordingly located at or adjacent the patient's ankle, while the proximal chamber 28 is located adjacent to the patient's knee.

The chambers 24, 26, and 28 are arranged fluidically in series and for this purpose the distal chamber 24 includes an inlet/outlet port or tube 30 (e.g., which is in fluid communication with a pump for selectively pressurizing/depressurizing the chambers 24, 26, and 28) as well as a first bleed tube or choke 32 which feeds into the mid chamber 26. A second bleed tube or choke 34 connects the mid chamber 26 to the proximal chamber 28. Save for the bleed tubes 32 and 34, the mid and proximal chambers are otherwise completely sealed, that is have no other ports or valves. Thus, in the embodiment shown, air fed into the inlet 30 will pass into the distal chamber 24, then through the first bleed tube 32 to the mid chamber 26 and finally from the mid chamber 26 through the second bleed tube 34 into the proximal chamber 28. Fluid is exhausted from the chambers sequentially in similar manner but opposite direction through the chambers and bleed tubes.

In one embodiment, the bleed tubes have the following dimensions. The first bleed tube 32 between the distal chamber 24 and the mid chamber 26 is 80 mm long, with an internal bore diameter of 0.8 mm; the second bleed tube 34 between the mid chamber 26 and the proximal chamber 28 is 20 mm long, with an internal bore diameter of 0.5 mm. Those of ordinary skill in the art will recognize that other dimensions may be utilized in order to better accommodate different anatomical structures (e.g., calf, thigh, etc.) and/or different sized patients (e.g., youth, adult, tall, bariatric, etc.). This structure of bleed tubes 32 and 34 is designed to control the rate of fluid bleed from one chamber to the next and therefore the rate of pressure increase within the sequence of chambers and as a result of the rate of change in pressure as well as the overall pressure generated by the chambers 24, 26, and 28 of the cuff 10 on the patient. This is described in further detail below.

Figure 5:
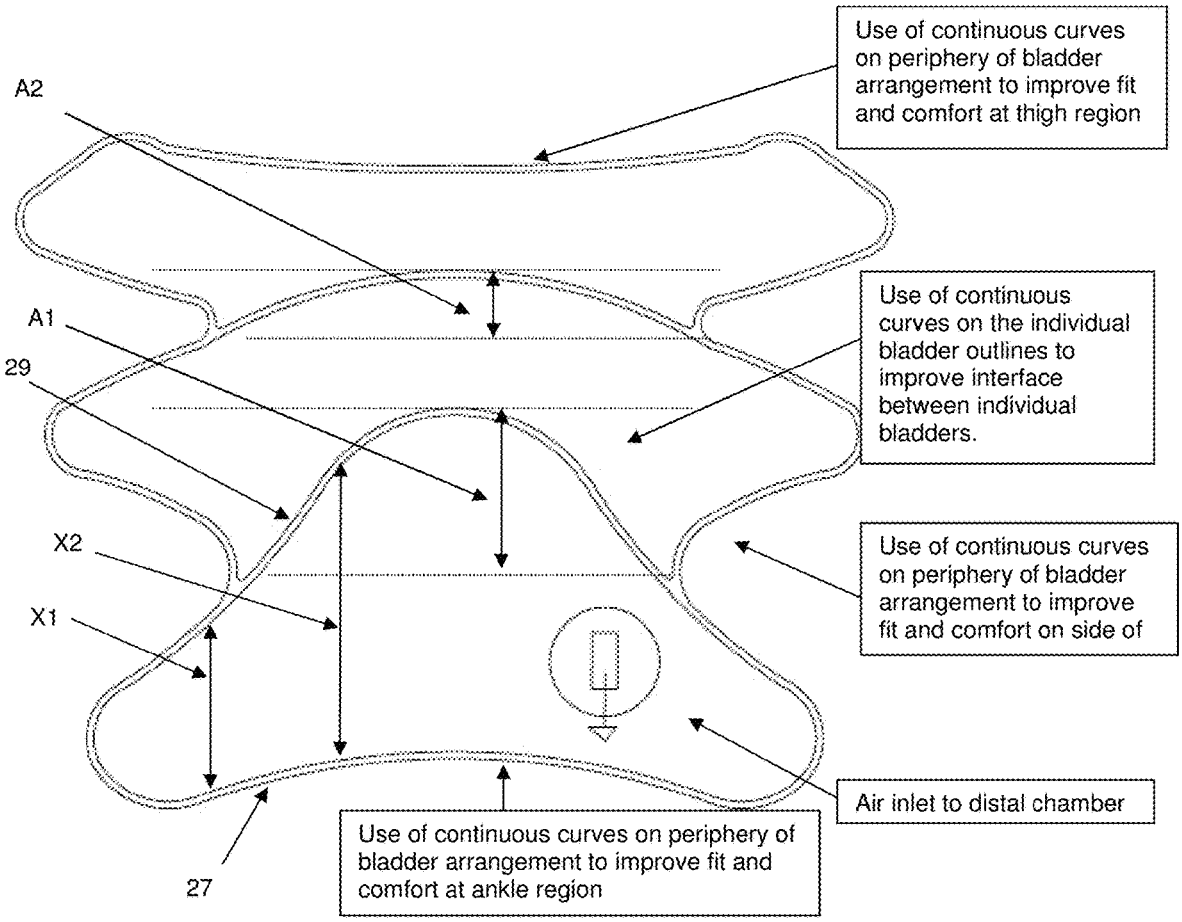
FIG. 5 shows the garment of FIG. 4 highlighting further features of the garment.

Referring now to FIG. 5, this is a schematic diagram of the bladder or cuff 10 of FIG. 4, highlighting a number of other features of the structure of the preferred embodiment.

More specifically, an additional improvement in the performance of the garment 10 can be achieved by the shape of the chambers 24, 26, and 28 and in particular the manner in which they are made to overlap in the garment 10. The chambers 2426 are designed to overlap longitudinally when fitted to the leg of the patient. Prior art cuffs have used distinct interfaces for each of the inflatable chambers of the garment, providing easily discernible separation between each chamber. As a result, circumferentially around the leg of a patient the periphery of the chambers provides a uniform shape with distinct and different chamber zones. In terms of the distance measured from the distal end of the garment, which could be described as the length or longitudinal extent of the cuff 10, each chamber has a definitive pressure value irrespective of the circumferential position under consideration.

With the structure of the embodiment shown, as detailed in FIGS. 4 and 5, the chambers 24, 26, and 28 are interspersed with each other to provide a blended progression of the chamber edges. The periphery of each chamber 24, 26, and 28 is not a uniform shape and is instead a sequence of curves. This creates overlapping areas between each adjacent set of chambers as identified in FIG. 5 as an area A1 between the chamber 24 and the chamber 26 and an area A2 between the chamber 26 and the chamber 28. Hence there are circumferential areas around the leg that have mid and distal chambers applied in different areas. That is, a patient may experience different pressures from multiple chambers about the circumference but at the same longitudinal distance along the length of the patient's leg due to the overlapping areas of the chambers, e.g., A1 and A2 of FIG. 5.

In terms of the distance measured from the distal end of the garment, designated in FIG. 5 with the reference numeral 27, each chamber may be arranged having a variable value along its width. For example, a peripheral edge 29 is identified in FIG. 5, which forms a boundary between the chambers 24 and 26. A set of example distances X1 and X2 are illustrated between the distal edge 27 and the peripheral edge 29 at two different locations along the width of the chambers 24 and 26. It can be appreciated that the distances X1 and X2 are different from each other and from many other distances measurable in this manner between the distal edge 27 and the peripheral edge 29. Similarly, each peripheral edge extending generally across the width of the chambers 24, 26, and/or 28 may be arranged having a variable distance between that edge and the distal edge 27. In other words, the width-wise extending peripheral edges of the chambers 24, 26, and 28 may be arranged such that they are not parallel or concentric.

In one embodiment, the most distally located chamber 24 is the largest in terms of volume, the next (middle) chamber 26 is smaller than the distal chamber 24, and the most proximal chamber 28 is smaller again. The chamber dimensions in one embodiment are approximately as follows: the middle chamber 26 is approximately 70% of the size of the distal chamber 24, while the proximal chamber 28 is approximately 55% of the size of the distal chamber 24. However, those of ordinary skill in the art will appreciated other relative chamber sizes, e.g., for different performances of garments according to the disclosed embodiments, or to accommodate different anatomical structures or sizes of such structures. The inflated volumes of the individual chambers are approximately in the same relative proportions.

The relationship of the size of the individual chambers 24, 26, and 28 is based on the shape of the patient's anatomical structure, e.g., leg, and the resulting chamber pressures are a function of this construction and the selected therapy pressure which is controlled by the pump.

The chamber design enables a higher mid-chamber pressure to be achieved compared to the prior art.

The effect of the blending together or overlap of the chambers 24, 26, and 28 has additional benefits in terms of comfort, fit, orientation, performance and efficiency.

The design of the individual chambers 24, 26, and 28 avoids the use of straight edges to provide improved comfort when the garment 10 is inflated. This reduces the obvious difference which is detectable by the patient between the individual inflatable chambers 24, 26, and 28. This is of particular benefit as there are different pressures in the various chambers. The prior art has a linear boundary between the individual chambers when wrapped circumferentially about a patient's anatomy, such as a calf.

It is to be appreciated that the use of continuous curves on the exterior of the bladder or chamber edges, regardless of the number of chambers, leads to additional advantages. For example, FIG. 11 illustrates a bladder 60, which essentially resembles the bladder 22 and can be used as part of the garment 10, but which may comprise only a single chamber 62 having a port 64 that can act as an inlet and/or outlet. Referring to both FIGS. 5 and 11, the bladders 22 and 60 include a plurality of lobes 66*a*, 66*b*, and 66*c* (collectively, "the lobes 66") alternating with notches 68*a* and 68*b* (collectively, "the notches 68"). Each of the lobes 66 may extend a width-wise distance, e.g., a distance D1 with respect to the lobe 66*a*, from a center line 60 of the chamber(s) that is greater than a corresponding distance of adjacent notches 68, e.g., a distance D2 with respect to the notch 68*a*.

The lobes 66 and notches 68 can provide various advantages. For example, they can provide a blending of the interface between the chamber area and the patient's leg. This reduces the obvious difference which is detectable by the patient between the inflatable multi-chamber area and the non-inflatable areas of the garment. The prior art has an orthogonal shape to the chamber and hence there is a linear boundary between the multi-chamber area and the rest of the garment.

As another example, pumps used with the lobes 66 can be sized such that the bladder 22 and/or 60 have a larger width and/or shorter length than prior art bladders, while maintaining a total volume that is equal to the volume of a prior art bladder. In this way, the bladders 22 and/or 60 are usable with the same pump as prior art bladders (which pumps are typically configured to operate properly at specific volumes). With respect to calves, there is relatively less circulatory effect to be gained by stimulating the distal portion, e.g., near the ankle, than the proximal portion, e.g., near the knee, since the bulk of muscle and blood vessels is located at the proximal portion. Thus, by shortening the length (and maintaining backwards compatibility with existing pumps by having the same volume), the same sized bladder can be used on a variety of different sized garments (e.g., garments smaller than can be accommodated by current bladders of similar volume), advantageously leading to manufacturing efficiencies, but without negatively impacting performance. That is, even if shorter in length with respect to prior shaped and sized bladders, the bladders 22 and/or 60 may be arranged to stimulate the most important portions of the patient's anatomy.

Additionally, the relatively increased width due to the lobes 66 extending in the width-wise direction enables the bladders 22 and/or 60 to circumferentially encircle a greater amount of the patient's anatomy. This may lead to an increased amount of the bladder directly squeezing the patient's anatomy to help promote circulation. Furthermore, the lobes 66 can be arranged to correspond with specific anatomical structures in the body, e.g., specific blood vessels or muscles portions, to better promote specific stimulation of these structures for improved circulation. Additionally, each of the lobes 66, formed as an extension from a main body of the bladder, has some degree of freedom to move (e.g., bend or twist) relative to the others of the lobes 66 and/or the main body of the bladder 22 and/or 22'. In this way, the lobes 66 may be useful to impart close conformance or compliance of the bladder 22 and/or 60 to the specific contours of a patient's anatomy (e.g., a calf is not a perfect cone or cylinder, and has bulges and contours, which may differ from patient to patient and accommodated for by the lobes 66).

In one embodiment, the difference between the lobe distance (e.g., D1) and the notch distance (e.g., D2) is between 10%-90% of the lobe distance (e.g., D1), and in a further embodiment, between 30%-70%. In one embodiment, the notch distance (e.g., D2) is between 10%-90% of the lobe distance (e.g., D1), and in a further embodiment, between 30%-70%. The lobes 66 and the notches 68 may be mirrored on opposite sides with respect to the center line 70, or misaligned, or included in different shapes, sizes, numbers, or arrangements on opposite sides. For example, there may be either a plurality of lobes and at least one notch alternatingly therebetween, or a plurality of the notches with at least one lobe alternatingly therebetween. A bladder 80 is illustrated in FIG. 12 having a single chamber 82, a port 84 providing inlet/outlet functions, and a plurality of lobes 86 alternatingly interspaced with respect to a plurality of notches 88. Thus, the bladder 80 may provide similar advantages to those discussed above with respect to the bladders 22 and 60, and is provided as an example of an alternate embodiment of a bladder including alternating lobes and notches. For example, it can be seen that the bladder 80 includes only two lobes 86 and two notches 88 on each lateral side thereof, as opposed to the three lobes 66 per side for the bladders 22 and/or 60. It can thus be appreciated that any number of lobes and/or notches, or any other arrangement, spacing, sizing, etc., can be included in other embodiments.

The peripheral edge of the multi-chamber arrangement is such that there are a number of curved areas that result in a different 3D form when inflated compared to the use of a linear boundary. The prior art has a more orthogonal shape with no interspacing of these areas. Hence in patients who have more tissue on the leg than others (such as bariatric patients with higher levels of fat) there are areas of the garment that tissue can move into during both initial garment fitting and during continued operational use to prevent excessive tightness.

Use of a curved chamber profile on the proximal edge in a multi-chamber garment to provide an improved fit to the upper leg/thigh, and/or to the lower leg/ankle.

The central line of the chambers 24, 26, 28 e.g., the center line 70 identified in FIG. 11, is intended to align with the centre of the rear of the leg, in the calf region. This is to ensure that the maximum compression of compliant tissue is achieved. Since the cuff has a defined shape, it is easier both align the cuff in the first place and for nursing staff to check continually that the garment 10 remains correctly aligned. This can be in addition to any marking provided for this purpose on the outside 14 of the garment 10.

The preferred embodiment of cuff 10 also exhibits improved performance through increased pneumatic efficiency. In particular, the preferred design offers and structure with greater pneumatic efficiency. The interleaving of the chambers 24, 26, and 28 results in a denser multi-chamber arrangement resulting in less patient surface area that is not being compressed as it is located in the space between individual chamber areas.

The initial applied force from the inflating chambers 24 and 26 occurs in the central area of the chamber shape as they are able to expand the most in this area. This area is aligned with the patient's central calf area where the largest amount of tissue is present and is therefore able to provide improved compressive therapy.

To improve the user experience and as a result increase compliance, pressure in the mid 26 and proximal chambers 26 is held via the bleed tubes 32 and 34, which are designed to reduce delivery pressure during the therapy period and bleed the air at the end of the active portion of therapy back through the garment 10 and the pump.

In use, the embodiment of DVT prophylaxis garment 10 described herein is designed to provide a sequential pressure gradient (distal to proximal) via a two layer bladder or cuff 10 incorporating the three chambers 24, 26, and 28 (although as explained above there could be just two chambers or more than three). Air pressure for the garment 10 can be provided by a standard DVT pump to the distal chamber 24 of the cuff through its inlet/outlet tube 30. Typically, 45 mm Hg pressure would be applied. The pressure in the mid 26 and proximal chambers 28 is derived from this pump pressure. Air pressure to the mid 26 and proximal 28 chambers is controlled by the interconnecting tubes 32 and 34, which are designed to "choke" the air into the subsequent chamber(s) 26, 28. The pressure drop from one chamber to the next, provided by the "choke", is a function of the length and internal bore diameter of the tubes 32, 34. In one example, a mid bladder pressure of 35 mmHg and proximal bladder pressure of 25 mmHg is achieved. This solution can be equally applied to a calf or calf and thigh garment, with the tube length and bore being changed to match the garment overall volume.

In the taught configuration there is no need to bleed air constantly to atmosphere (at the garment) to control bladder pressures. The distal and proximal pressures are controlled purely by the "choke" tubes.

On completion of the pressure ramp-up and hold period (for example, 12 seconds), the bladder or cuff 10 is deflated. The pump is configured to deflate and wait before the next therapy cycle for a rest period, for example of 48 seconds. The deflation allows for venous refill and prepares the garment 10 for the subsequent therapy cycle. During this deflate and hold period, the pressures in each of the three chambers 24, 26, and 28 is vented back through the "choke" tubes 32, 34 from proximal to mid to distal chambers 26, 28, as well as through the inlet/outlet tube 10 and, where provided, the pump internal rotary valve to atmosphere.

With the taught structure there are only two independent variables within the design: a) the individual chamber volume, and b) the dimensions of the interconnecting bleed tubes. Reducing the number of independent variables improves the repeatability of the manufacturing process and therefore reduces the risks of any inaccuracies caused by mass production.

The lack of prior art bleed valves in the structure provides for a number of improvements, including: a) reduction in the manufacturing cost of the garment; b) improved garment surface without the physical protuberances of the bleed valves; and c) removal of noise associated with venting to atmosphere at the bleed valves.

Figure 6:
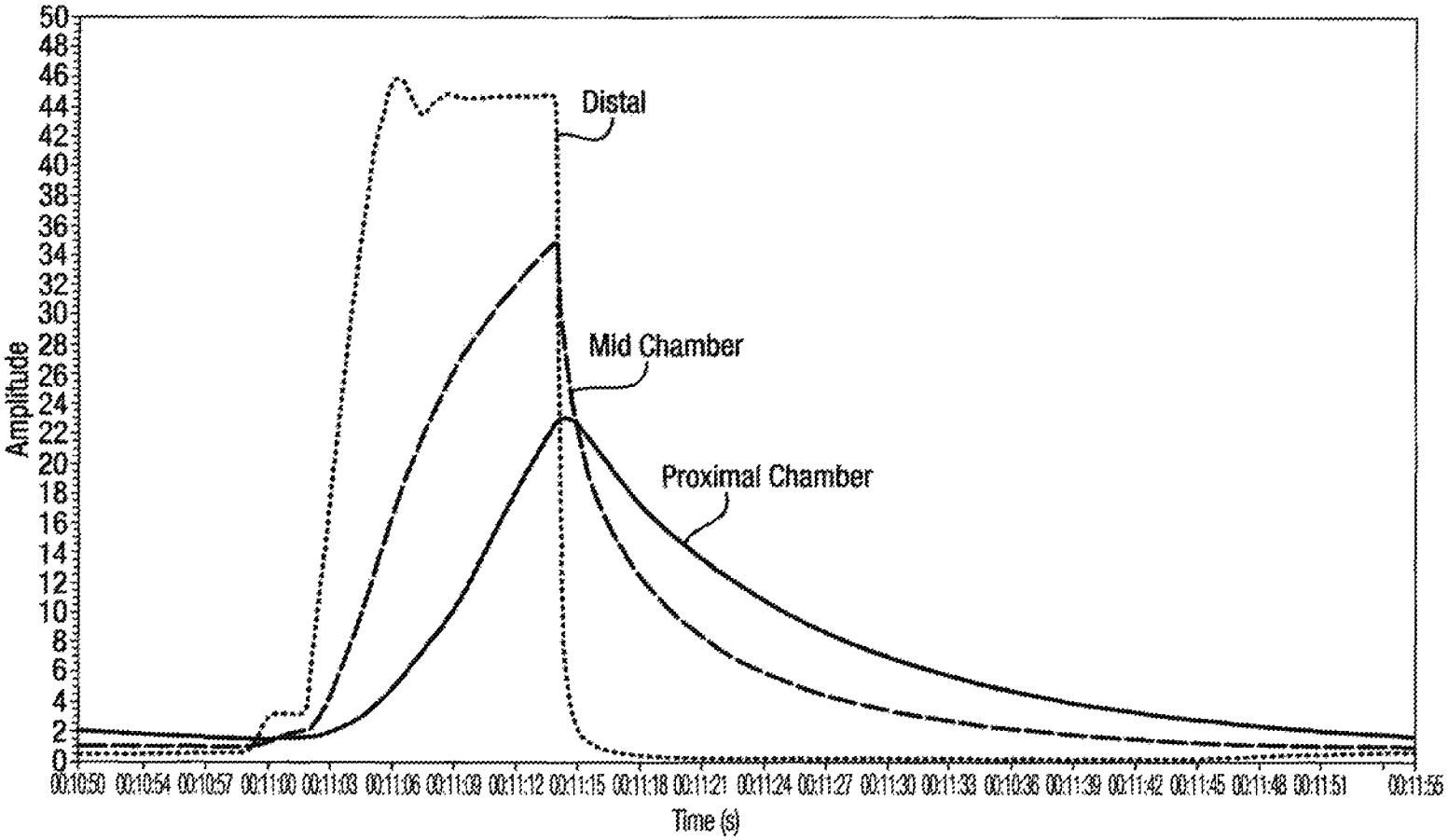
FIGS. 6 and 7 are comparative graphs showing the pressure profiles of the garment of FIGS. 2 to 5 compared to a garment produced in accordance with the teachings of US-2005/070,828.
Figure 7:
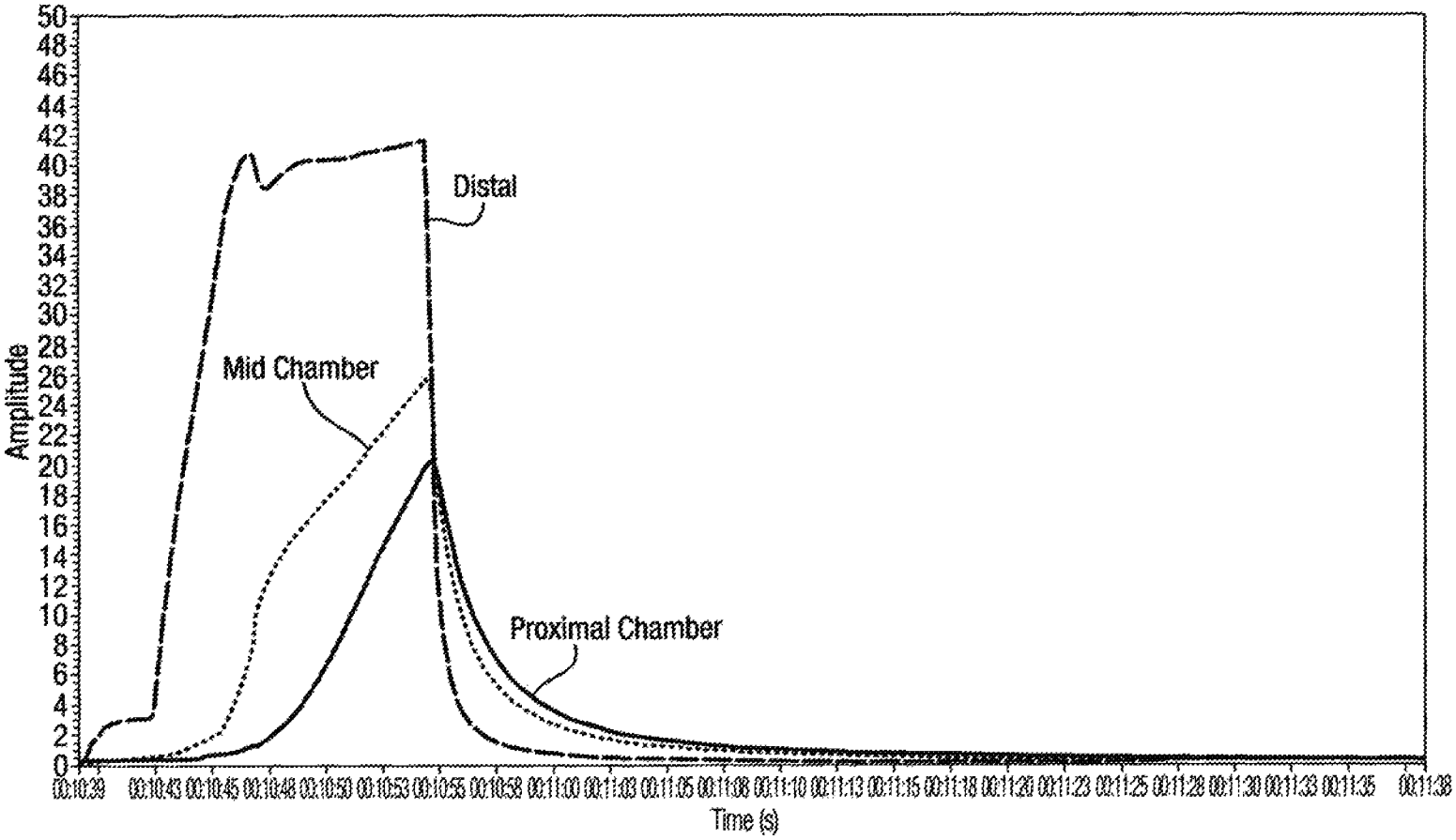

In one example embodiment, a test calf garment 10 was connected to a Flowtron pump (513003) and run for an extended period to confirm repeatability and accuracy of therapy delivery. FIG. 6 shows the pressure profiles for the garment 10, measured at the garment inlet tube 30, mid chamber 26 and proximal chamber 28, via bleed grommets provided for testing purposes only in the test garment. FIG. 7 shows the pressure profile for a garment constructed in accordance with the teachings of US-2005/070,828.

As explained above, in order to obtain maximum performance, the garment 10 generates the maximum clinical effect during the first period where pressure is applied, whilst also maximising the clinical effect during the second rest period. These two periods require different functions and characteristics in order to optimise the overall therapy applied and the resulting clinical effects. The garment 10 achieves this by using the combination of an improved inflation characteristic and an improved deflation characteristic.

A comparison of FIGS. 6 and 7 shows a different initial inflation ramp between the cuff 10 compared to the prior art. There is an identifiable greater than 2 second delay in the ramp period between the start of inflation of the distal chamber 24 compared to the other two chambers 26, 28 in the prior art device. The cuff 10 taught herein does not exhibit this initial delay and is still capable of maintaining a differential pressure gradient between individual chambers 24, 26, and 28 as the pressures rise during the ramp and hold periods. Also, it can be seen that at corresponding points in the ramp and hold sections shown in FIGS. 6 and 7, the preferred cuff 10, as shown in FIG. 6, is able to provide a higher mid-chamber pressure than the prior art, as shown in FIG. 7.

As a result of both of the reduction in delay and higher mid-chamber 26 pressure, the cuff 10 is able to provide more compressive force for a longer period during the cycle. This results in there being more pressure and for longer in the various chambers 24, 26, and 28 of the cuff 10 compared to prior art structures, while the sequential nature of inflation and deflation are still maintained. This is analogous to the principle of applied power equating to the area under the curve.

The physical shape of the individual chambers 24-28 and the spatial relationship of the individual chambers 24-28 also add to this effect, detailed further below.

Figure 8:
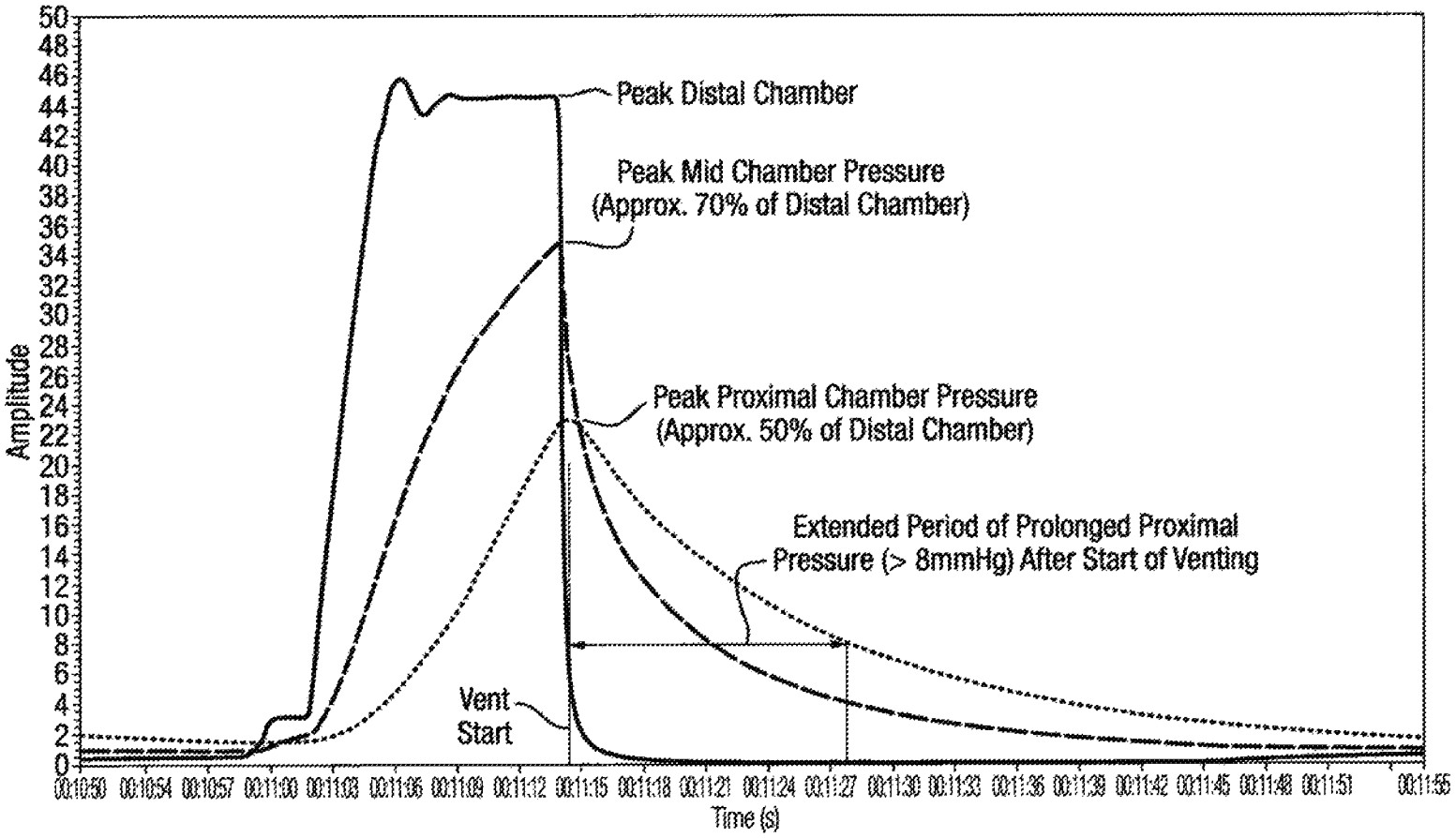
FIGS. 8 and 9 are comparative graphs showing further detail of the pressure profiles of the garment of FIGS. 2 to 5 compared to a garment produced in accordance with the teachings of US-2005/070,828.
Figure 9:
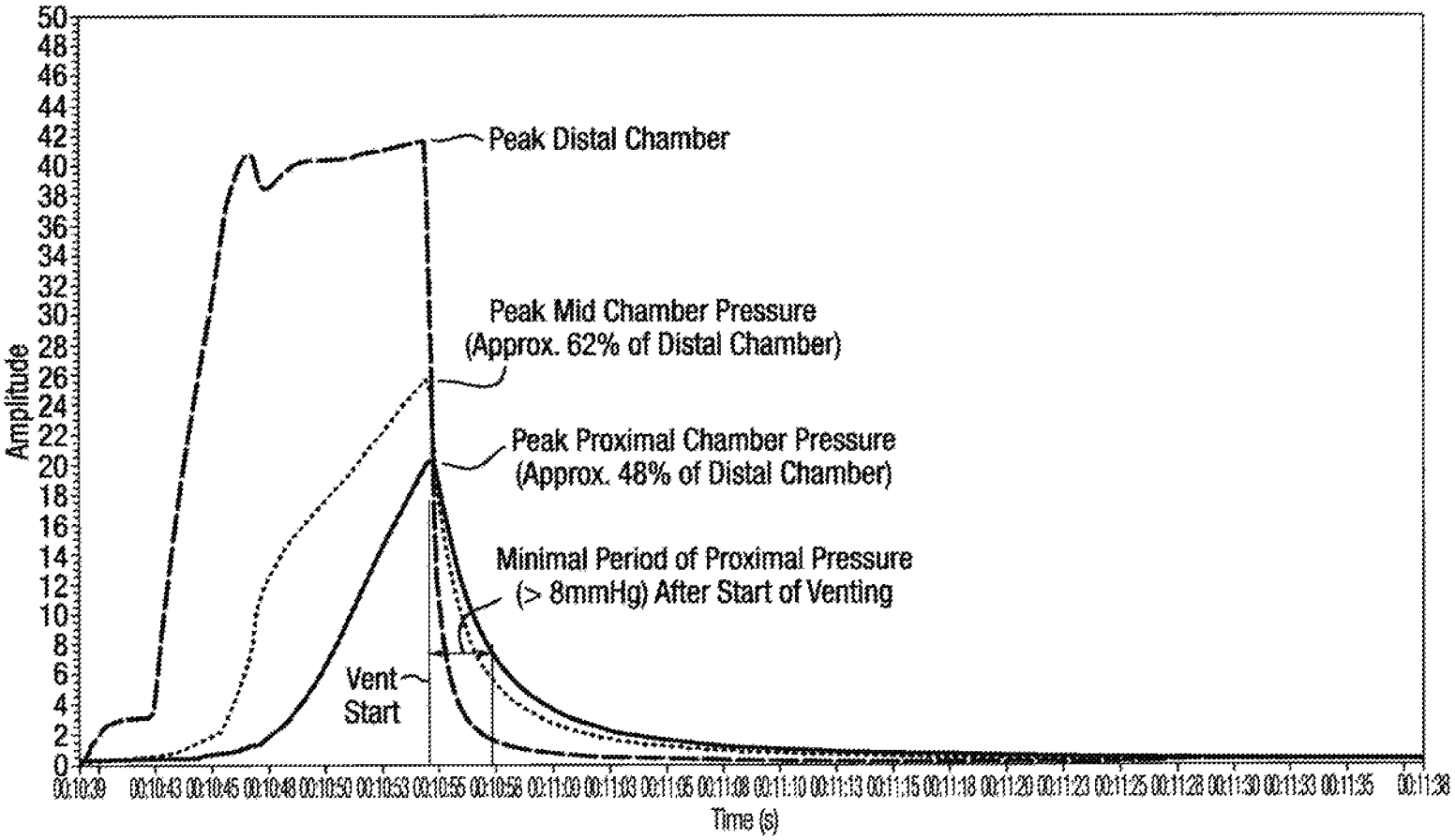

In FIG. 6 it can also be seen that the cuff 10 exhibits slower deflation of the proximal 28 and mid 26 chambers compared to the prior art, as can be seen with reference to FIG. 7. This is shown in more detail in FIG. 8 (cuff 10) and FIG. 9 (prior art). This slower deflation results in a prolonged application of pressure even after the deflation of the distal chamber 24 occurs. This is because all the air flow has to go back through the tubes 30, 32, and 34 to the pump and there are no bleeds to atmosphere. The air pressure in the proximal chamber 28 cannot drop until the pressure in the mid chamber 26 has dropped, which in turn cannot drop until that of the distal chamber 24 has been reduced.

By having the series connection in the chamber connections creates a series related pressure profile. Thus, the mid and proximal chambers 26, 28 have a slower decay of pressure with time, the pressure thus being sustained for a longer duration than in the prior art.

While the pressure levels are lower compared to those during the hold part of the inflation period, they are present and can be considered to be approximate to that provided by a permanent compressive force (e.g. a compression stocking). This provides an additional advantage in terms of the performance of the garment 10 not previously present in the art.

Thus, the pressure versus time profile of the deflation part of the cycle is able to provide part of the same compressive effect that could be provided by elasticated compression hosiery. This results in an intermittent compression garment that also has an additional performance characteristic typically only found in a compression stocking but without the associated clinical issues associated with constant compression of the limb.

The resulting effect is to provide a longer period of sustained compression. This is shown in the example embodiment of FIGS. 6 and 8, where greater than 8 mmHg is present at the ankle/proximal for approximately 18 seconds over the 60 second cycle time, even though the actual air source is only provided for 12 seconds of the 60 second cycle time. There is therefore a residual compressive force provided at the lower leg/ankle even when the air pressure from the source is removed. This provides additional augmentation to the existing therapeutic effect associated with the intermittent compression cycle.

As a result of this staggered deflation characteristic in terms of pressure versus time for each of the chambers 24, 26, and 28 and the prolonged lower residual pressure the preferred structure of garment 10 provides for a more sustained effect on the blood augmentation.

Also, for patients with compromised valves in their veins, for example suffering from superficial venous reflux, this improved performance may offer a particular but significant benefit, namely in assisting in the prevention of reflux of blood. The effectiveness of an IPC system may therefore be enhanced in this type of patient.

It is preferred that the chambers are arranged fluidically in series, as in the embodiment described below, but in other embodiments they could be arranged in parallel, thereby providing a different pressure profile. Similarly, there may be provided more than one chamber directly coupled to the first or a previous chamber in the sequence and in practice in the same longitudinal position of the garment, with the same or different chokes, to provide different pressure profiles at different angular positions (sides) of the garment.

Figure 10:
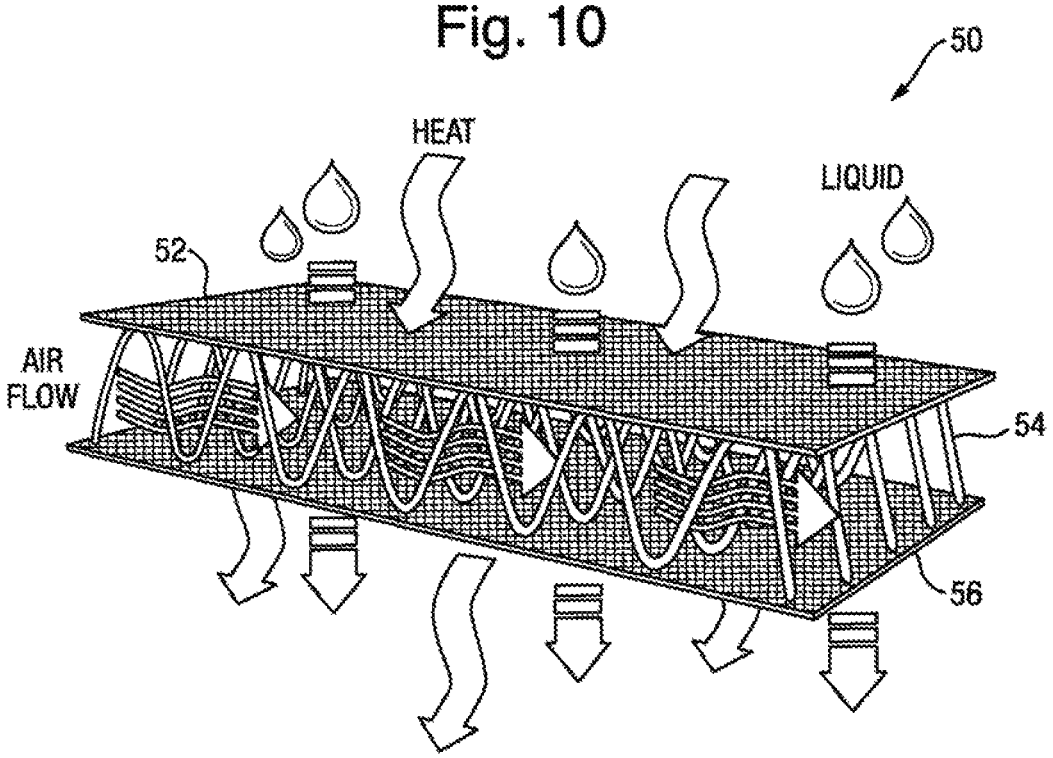
FIG. 10 in an exploded view of an embodiment of spacer layer for a garment of the type disclosed herein.

Referring now to FIG. 10, this shows an embodiment of spacer layer which is particularly suitable to DVT garments of the types contemplated herein. The spacer layer would be disposed on the patient contact side of the garment and therefor in direct contact with the patient. Such a spacer layer is intended to improve breathability and provide comfort in DVT prophylaxis garments. It is also able to provide improved insulation, compression strength, durability, recyclability, pressure redistribution and high moisture vapour transmission (MVTR).

In particular, known DVT garments are manufactured using three or four layers of materials: two layers for the internal bladder, the therapy providing element, while the outer two layers provide the aesthetics and attachment areas for the garment. Some garments use foam laminated material as the skin contact material. The polyurethane foam provides the cushioning comfort. However, the foam has to be laminated using either adhesive or a flame bonding process, both of which tend to block at least some of the cellular holes in the foam, reducing its breathability. The foam also tends to be affected by UV light, typically as discoloration. Furthermore, the laminating process adds cost and renders the garment non-recyclable.

Referring to FIG. 10, this shows an embodiment of spacer layer, which includes a liquid and air permeable contact layer 52, a three-dimensional knitted or woven layer 54 and a support layer 56, which may be one of the bladder layers. The support layer 56 may also be fluid and air permeable in the case that it is provided as an independent layer of the garment. The three-dimensional knitted or woven layer 54 provides a space between the layers 52 and 56 to allow for the collection of water vapour and air passing through the contact layer 52, and also provides air and fluid passages across the layer 54, through the interstices between the fibres of the layer 54, which could be considered as providing channels through the layer 54. This space also provides insulation.

The layer 54 can be formed in a single knitting or weaving process, which can achieve the benefits of foam or fabric laminates without the additional processes involved with those prior art structures. The strength provided by the fibres in the construction of the 3D structure of layer 54 provides compression strength, which also provides cushioning, comfort and pressure re-distribution in the garment. The fabric structure of the layer 54 provides durability due to its construction and the yarn used. By contrast, foam used in prior art laminates is a weak material, reducing the overall strength of the device.

It has been found that a knitted or woven layer 54 can provide a vapour transmission rate of 35 $g/m^2$ per 24 hours or more, which is significantly greater than some prior art garments.

The invention claimed is:

1. An inflatable garment for application to a patient comprising:

a first inflatable chamber and a second inflatable chamber disposed adjacent one another and in fluid communication with each other, said first inflatable chamber and said second inflatable chamber being separated from one another by a first separation wall; and at least one additional inflatable chamber disposed adjacent with said second inflatable chamber, the second and the at least one additional inflatable chamber separated from one another by a second separation wall, wherein said second separation wall is curved, wherein said second and said at least one additional inflatable chamber overlap in a longitudinal direction when the inflatable garment is in a tubular form, wherein said first and second separation walls have different curvatures, wherein said first separation wall has a greater curvature from a first end of said first separation wall to a second end of said first separation wall than said second separation wall from a first end of said second separation wall to a second end of said second separation wall, thereby providing greater overlap between said first and second inflatable chambers than the overlap between said second and said at least one additional inflatable chamber, and wherein the second inflatable chamber comprises a first pair of outermost side edges, the at least one additional inflatable chamber comprises at least a second pair of outermost side edges, wherein each of the first pair of outermost side edges comprises only one convex curve and only one concave curve positioned between the first separation wall and the second separation wall, wherein the concave curves of the first pair of outermost side edges are positioned closer to the first separation wall than the convex curves of the first pair of outermost side edges, and the convex curves of the first pair of outermost side edges are positioned closer to the second separation wall than the concave curves of the first pair of outermost side edges, wherein a distance between the concave curves of the first pair of outermost side edges is smaller than a distance between the convex curves of the first pair of outermost side edges, wherein each of the at least second pair of outermost side edges comprises a convex curve and a concave curve positioned between the second separation wall and a third separation wall.

2. The inflatable garment according to claim 1, further comprising:

a choke connected either from said first inflatable chamber to said second inflatable chamber or from said second inflatable chamber to said at least one additional inflatable chamber.

3. The inflatable garment according to claim 2, wherein said second inflatable chamber is approximately 70% of the size of the first inflatable chamber.

4. The inflatable garment according to claim 1, wherein said first inflatable chamber has a curved wall at a side opposite said first separation wall.

5. The inflatable garment according to claim 1, wherein the first and second inflatable chambers are two of at least three inflatable chambers arranged in series.

6. The inflatable garment according to claim 1, wherein a first choke is connected from said first inflatable chamber to said second inflatable chamber and a second choke is connected from said second inflatable chamber to said at least one additional inflatable chamber, and wherein the first and second chokes are sized to provide a different rate of inflation and deflation to the respective inflatable chambers.

7. The inflatable garment according to claim 6, wherein the first and second chokes are in a form of connecting tubes.

8. The inflatable garment according to claim 6, wherein the first choke has a length of about 80 millimeters (mm) and an internal bore diameter of about 0.8 millimeters (mm).

9. The inflatable garment according to claim 8, wherein the second choke has a length of about 20 mm and an internal bore diameter of about 0.5 mm.

10. The inflatable garment according to claim 1, wherein said first and second separation walls have a curved shape when the inflatable garment is in a flat condition.

11. The inflatable garment according to claim 1, wherein the first, second, and at least one additional inflatable chambers have curved peripheries.

12. The inflatable garment according to claim 1, wherein the first inflatable chamber is larger than each of the second and at least one additional inflatable chamber.

13. The inflatable garment according to claim 12, wherein the second inflatable chamber is approximately 55% of the size of the first inflatable chamber.

14. The inflatable garment according to claim 1, wherein the inflatable garment has a length, a width and a contour, the first, second, and at least one additional inflatable chambers being curved along the width of the inflatable garment.

15. The inflatable garment according to claim 1, wherein the third separation wall is a curved wall opposite said second separation wall.

16. The inflatable garment according to claim 1, including a contact member which includes a knitted or woven layer.

17. The inflatable garment according to claim 1, wherein the inflatable garment is a cuff or sleeve, shaped or shapeable to fit around a part of an anatomy of a patient.

* * * * *